US010693280B2

(12) United States Patent
Akiyoshi

(10) Patent No.: US 10,693,280 B2
(45) Date of Patent: Jun. 23, 2020

(54) SPARK PLUG

(71) Applicant: DENSO CORPORATION, Kariya, Aichi-pref. (JP)

(72) Inventor: Ryohei Akiyoshi, Kariya (JP)

( * ) Notice: Subject to any disclaimer, the term of this patent is extended or adjusted under 35 U.S.C. 154(b) by 0 days.

(21) Appl. No.: 16/595,885

(22) Filed: Oct. 8, 2019

(65) Prior Publication Data

US 2020/0112145 A1 Apr. 9, 2020

(30) Foreign Application Priority Data

Oct. 9, 2018 (JP) ..... 2018-191255

(51) Int. Cl.

| | |
|---|---|
| ***H01T 13/32*** | (2006.01) |
| ***H01T 13/39*** | (2006.01) |
| ***H01T 21/02*** | (2006.01) |
| ***H01T 13/02*** | (2006.01) |

(52) U.S. Cl.

CPC ..... *H01T 13/32* (2013.01); *H01T 13/02* (2013.01); *H01T 13/39* (2013.01); *H01T 21/02* (2013.01)

(58) Field of Classification Search

CPC ..... H01T 13/32
USPC ..... 313/141
See application file for complete search history.

(56) References Cited

U.S. PATENT DOCUMENTS

| | | | | |
|---|---|---|---|---|
| 2010/0264803 | A1* | 10/2010 | Nunome | H01T 13/39 313/141 |
| 2014/0361678 | A1* | 12/2014 | Murayama | H01T 13/32 313/141 |
| 2016/0053733 | A1* | 2/2016 | Aochi | H01T 13/02 313/120 |
| 2019/0103731 | A1* | 4/2019 | Tanaka | H01T 13/04 |
| 2019/0386467 | A1* | 12/2019 | Nishio | H01T 13/32 |

FOREIGN PATENT DOCUMENTS

| | | |
|---|---|---|
| JP | 2016-184558 | 10/2016 |
| JP | 2017-147086 | 8/2017 |
| JP | 2019-125570 | 7/2019 |

* cited by examiner

*Primary Examiner* — Christopher M Raabe
(74) *Attorney, Agent, or Firm* — Nixon & Vanderhye PC

(57) ABSTRACT

A spark plug includes a ground electrode that is curved to oppose a tip end surface of a center electrode. A predetermined virtual plane that passes through a center axis of the spark plug along the curved ground electrode faces a flow direction of airflow. The ground electrode includes a main body including: an opposing surface on a first side facing the tip end surface of the center electrode; and a sloped surface on a second side opposite the first side. The main body satisfies 10 [°]≤Dg≤70 [°], 1.0 [mm]≤Th, and 1.5 [mm]≤Wd, where Dg is a slope angle of the sloped surface relative to the opposing surface, Th is a thickness of the main body in an insertion direction of the center electrode, and Wd is a width of the ground electrode in a direction perpendicular to the virtual plane.

10 Claims, 8 Drawing Sheets

SPARK PLUG

CROSS-REFERENCE TO RELATED APPLICATION

This application is based on and claims the benefit of priority from Japanese Patent Application No. 2018-191255, filed Oct. 9, 2018. The entire disclosure of the above application is incorporated herein by reference.

BACKGROUND

Technical Field

The present disclosure relates to a spark plug.

Related Art

The following spark plug is known. The spark plug includes a center electrode and a ground electrode, in which a plane along the ground electrode that is curved is perpendicular to a flow direction of airflow.

SUMMARY

One aspect of the present disclosure provides a spark plug that includes a ground electrode that is curved to oppose a tip end surface of a center electrode. A predetermined virtual plane that passes through a center axis of the spark plug along the curved ground electrode faces a flow direction of airflow. The ground electrode includes a main body including: an opposing surface on a first side facing the tip end surface of the center electrode; and a sloped surface on a second side opposite the first side. The main body satisfies 10 [°]≤Dg≤70 [°], 1.0 [mm]≤Th, and 1.5 [mm]≤Wd, where Dg is a slope angle of the sloped surface relative to the opposing surface, Th is a thickness of the main body in an insertion direction of the center electrode, and Wd is a width of the ground electrode in a direction perpendicular to the virtual plane.

DESCRIPTION OF THE EMBODIMENTS

Figure 1:
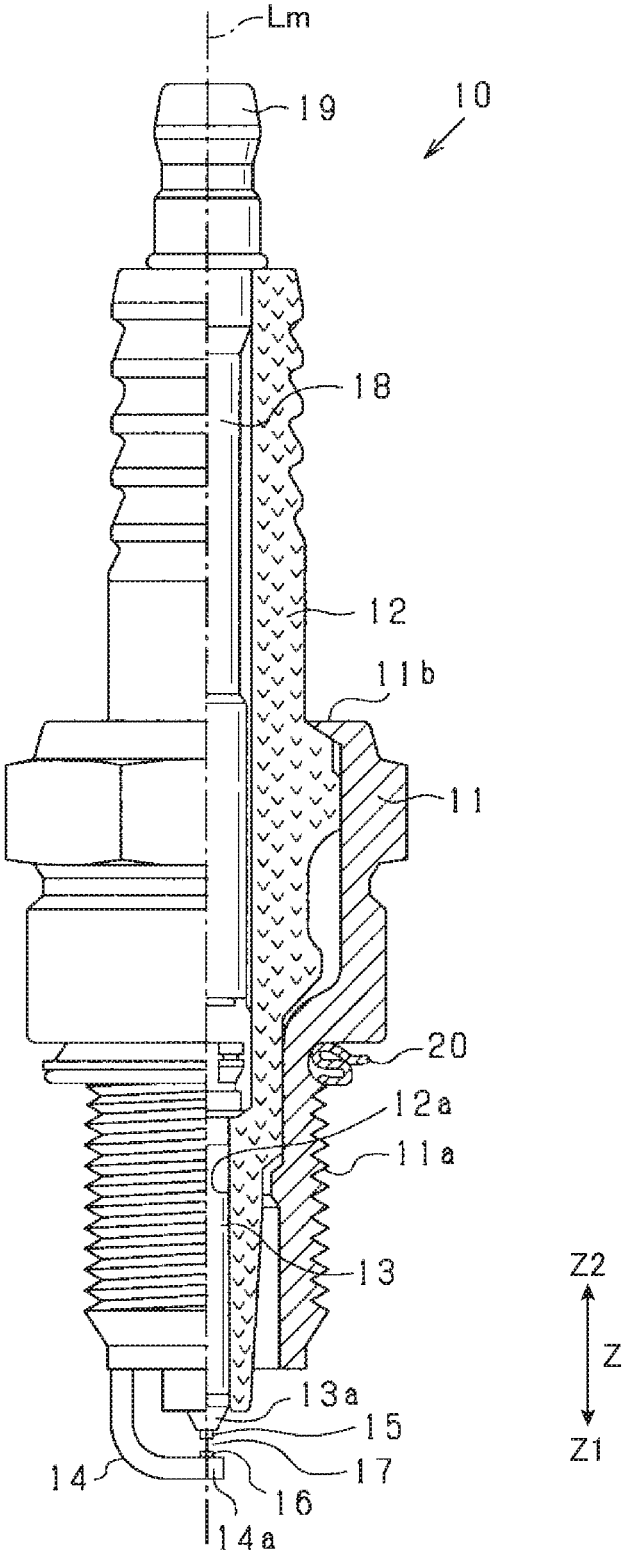
FIG. 1 is a half cross-sectional view of a spark plug according to a first embodiment.

The following spark plug is conventionally known (refer to JP-A-2017-147086). The spark plug includes a center electrode and a ground electrode, in which a plane along the ground electrode that is curved is perpendicular to a flow direction of airflow. In the spark plug described in JP-A-2017-147086, when the airflow flows from left to right between the center electrode and the ground electrode, taking the directions as shown in the diagrams as shown in the above patent reference, a lower side of the ground electrode is sloped downward to the right, and a protruding portion is provided further towards an upstream side of the airflow than a center axis of the center electrode on an upper side of the ground electrode. As a result, a trailing vortex is formed on a downstream side of the ground electrode. A discharge spark that is extended is drawn into the trailing vortex and held.

However, in the spark plug described in JP-A-2017-147086, although the side on the lower side of the ground electrode is formed so as to slope downward to the right, this configuration alone may not be enough to enable ignitability of an air-fuel mixture to be improved.

It is thus desired to provide a spark plug that is capable of improving ignitability of an air-fuel mixture.

An exemplary embodiment of the present disclosure provides a spark plug that includes: a cylindrical main metal fitting that includes an interior portion; a center electrode that is inserted into the interior portion of the main metal fitting and includes a tip end surface; and a ground electrode that is connected to the main metal fitting and curved so as to oppose a tip end surface of the center electrode. A predetermined virtual plane that passes through a center axis of the spark plug along the curved ground electrode faces a flow direction of airflow in the spark plug.

In the spark plug, the center electrode and the ground electrode oppose each other and form a spark discharge gap. The ground electrode includes a main body that includes: an opposing surface that is formed on a first side facing the tip end surface of the center electrode, the opposing surface being perpendicular to a center axis of the spark plug; and a sloped surface that is formed on a second side opposite the first side facing the tip end surface of the center electrode, the sloped surface becoming farther away from the tip end surface of the center electrode from an upstream side of the airflow towards a downstream side. The main body of the ground electrode satisfies 10 [°]≤Dg≤70 [°], 1.0 [mm]≤Th, and 1.5 [mm]≤Wd, where Dg is a slope angle of the sloped surface relative to the opposing surface, Th is a thickness of the main body of the ground electrode in an insertion direction of the center electrode, and Wd is a width of the ground electrode in a direction perpendicular to the virtual plane.

In the above-described configuration, the ground electrode that is connected to the main metal fitting is curved so as to oppose the tip end surface of the center electrode. Airflow flows towards the virtual plane along the curved ground electrode, that is, from an area to the side of the ground electrode towards the center electrode and the ground electrode. Then, discharge is performed between the center electrode and the ground electrode, and an air-fuel mixture is ignited by a discharge spark.

Here, in the main body of the ground electrode, the opposing surface that is perpendicular to the center axis of the spark plug is formed on the first side facing the tip end surface of the center electrode. Therefore, airflow that flows between the center electrode and the ground electrode is regulated by the opposing surface. The discharge spark can be stably extended.

In addition, in the main body of the ground electrode, the sloped surface that becomes farther away (recedes) from the tip end surface of the center electrode from the upstream side of the airflow towards the downstream side is formed on the second side opposite the first side facing the tip end surface. Therefore, the airflow is led in a direction away from the center electrode, and negative pressure is formed on the downstream side of the ground electrode. As a result of the negative pressure, the airflow that passes between the center electrode and the ground electrode, and furthermore, the discharge spark can be led in the direction away from the center electrode. Consequently, the discharge spark can be extended in the direction away from the center electrode and ignitability of the air-fuel mixture can be improved.

Here, the main body of the ground electrode satisfies 1.0 [mm]≤Th and 1.5 [mm]≤Wd, where Th is the thickness of the main body of the ground electrode in the insertion direction of the center electrode, and Wd is the width of the ground electrode in the direction perpendicular to the virtual plane. Therefore, negative pressure that is sufficient enough to enable the discharge spark to be extended in the direction away from the center electrode can be formed by the sloped surface.

Furthermore, the inventors of the present application have confirmed that ignitability of the air-fuel mixture can be improved when the main body of the ground electrode satisfies 10 [°]≤Dg≤70 [°], where Dg is the slope angle of the sloped surface relative to the opposing surface. Therefore, as a result of the above-described spark plug, ignitability of the air-fuel mixture can be improved.

Embodiments implementing a spark plug that is used in an internal combustion engine will hereinafter be described with reference to the drawings.

First Embodiment

FIG. 1 shows a spark plug 10 according to a first embodiment that is used for an internal combustion engine. In the present specification, a direction in which a center axis Lm of the spark plug 10 extends is referred to as an axial direction Z. In addition, a side of the spark plug 10 in the axial direction Z on which a combustion chamber (not shown) of an internal combustion engine (not shown) is formed is referred to as a tip end side (distal end side) Z1. A side of the spark plug 10 opposite the distal end side refers to a base end side (proximal end side) Z2. In addition, a circumferential direction of the spark plug 10 is simply referred to as a circumferential direction. Moreover, a radial direction of the spark plug 10 is simply referred to as a radial direction.

As shown in FIG. 1, the spark plug 10 includes a circular cylindrical housing 11 that includes a metal material such as iron. A screw portion 11*a* is formed on an outer circumference of a lower portion of the housing 11. According to the present embodiment, the housing 11 corresponds to a "main metal fitting."

A lower end portion of a circular cylindrical insulator 12 is coaxially inserted into an inner portion of the housing 11. The insulator 12 is molded from an insulating material such as alumina. The housing 11 and the insulator 12 are integrally coupled by an upper end portion 11*b* of the housing 11 being crimped to the insulator 12. In addition, a center electrode 13 is inserted into and held in a through-hole 12*a* in a lower portion (one end portion) of the insulator 12.

The center electrode 13 includes a nickel (Ni) alloy that has excellent heat resistance and serves as a base material. The center electrode 13 is formed into a circular columnar shape. The Ni alloy has excellent heat resistance and the like. Specifically, an inner material (core material) of the center electrode 13 includes copper, and an outer material (outer casing material) includes a Ni-based alloy. A tip end portion 13*a* of the center electrode 13 is exposed from a lower end (one end) of the insulator 12. According to the present embodiment, the center electrode 13 is arranged such that a center axis thereof coincides with a center axis Lm (see FIG. 3) of the spark plug 10.

The ground electrode 14 is arranged in a position opposing the tip end portion 13*a* of the center electrode 13. The ground electrode 14 extends in an integrally curved manner from a lower end surface (one end surface) of the housing 11. That is, the ground electrode 14 is connected to the housing 11 and curved such that a tip end portion 14*a* thereof opposes a tip end surface 15*a* (see FIG. 2) of the center electrode 13. The ground electrode 14 also includes a Ni-based alloy.

Figure 2:
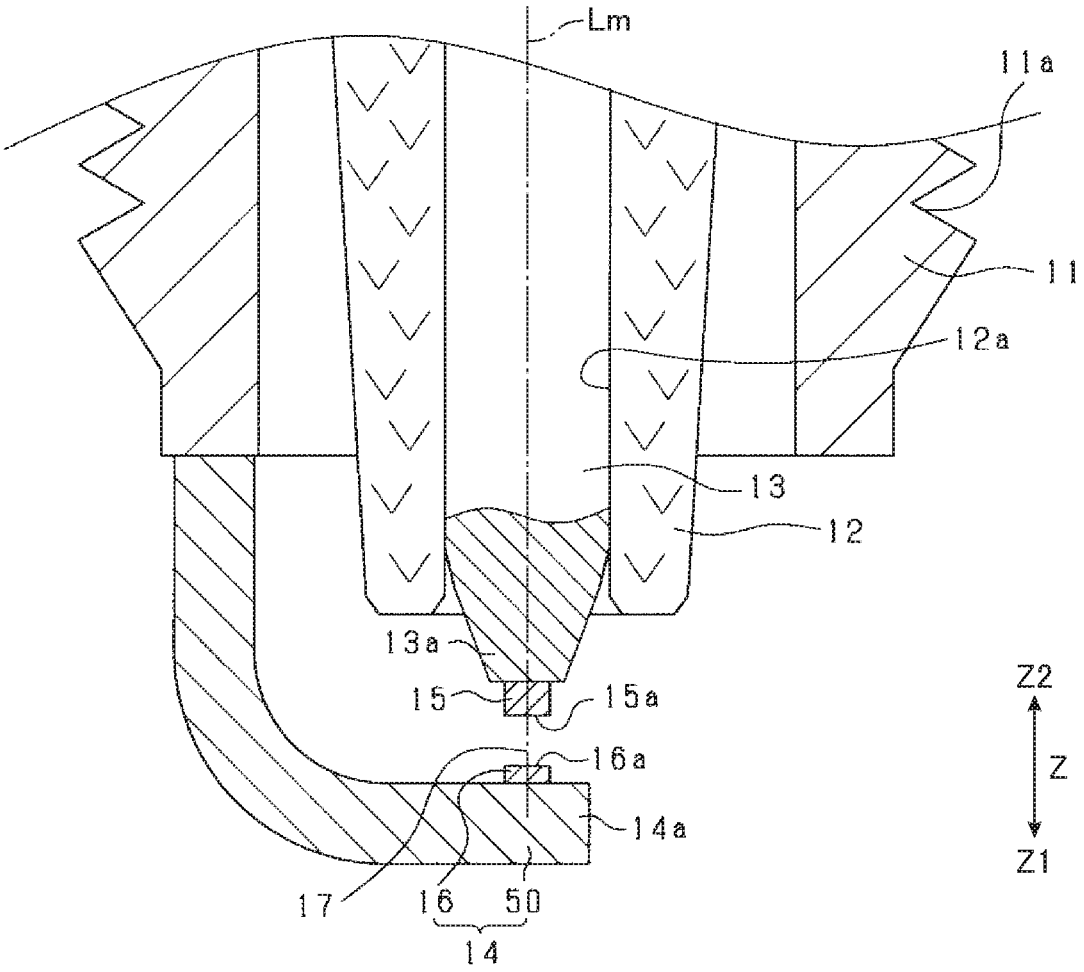
FIG. 2 is an enlarged view of a part of FIG. 1.

As shown in FIG. 2, the center electrode 13 and the ground electrode 14 respectively include noble-metal chips 15 and 16. Each of the noble-metal chips 15 and 16 are in a circular columnar shape. Each of the noble-metal chips 15 and 16 include an iridium-rhodium (IrRh) alloy in which: Ir has a high melting point and excellent wear resistance and serves as a base; and Rh is used for suppressing high-temperature volatility of Ir. According to the present embodiment, the IrRh alloy corresponds to a "noble metal." The noble-metal chip 15 corresponds to a "first protruding portion." The noble-metal chip 16 corresponds to a "second protruding portion."

The noble-metal chips 15 and 16 are respectively joined to the tip end portions 13*a* and 14*a* by a joining process such as laser welding or resistance welding. A spark discharge gap 17 is formed between the noble-metal chip 15 and the noble-metal chip 16. That is, discharge is performed between the noble-metal chip 15 and the noble-metal chip 16, and a discharge spark is formed. Here, a tip end surface of the noble-metal chip 15 corresponds to the tip end surface 15*a* of the center electrode 13. In addition, a portion of the ground electrode 14 excluding the noble-metal chip 16 corresponds to a main body (hereinafter referred to as an electrode main body) 50 of the ground electrode 14.

Returning to the description of FIG. 1, as is known, a center axis member 18 and a terminal portion 19 are electrically connected in an upper portion of the center electrode 13. An external circuit that applies a high voltage for spark generation is connected to the terminal portion 19. In addition, a gasket 20 that is used for attachment to an internal combustion engine is provided in an upper end portion of the screw portion 11*a* of the housing 11. In a state in which the spark plug 10 is attached to a combustion chamber of the internal combustion engine, the center electrode 13 and the ground electrode 14 of the spark plug 10 are exposed to the combustion chamber.

Figure 3:
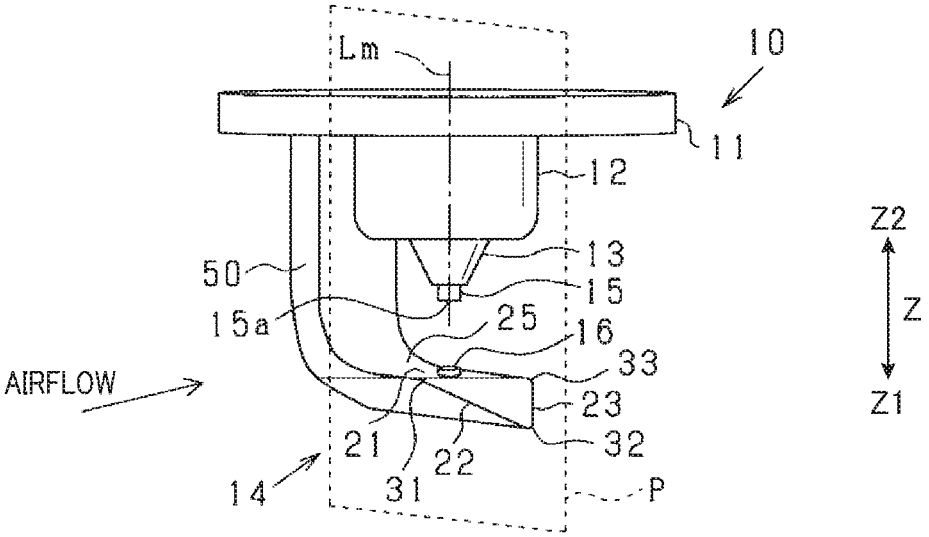
FIG. 3 is a perspective view of a tip end portion of a center electrode and a ground electrode provided in the spark plug.
Figure 4:
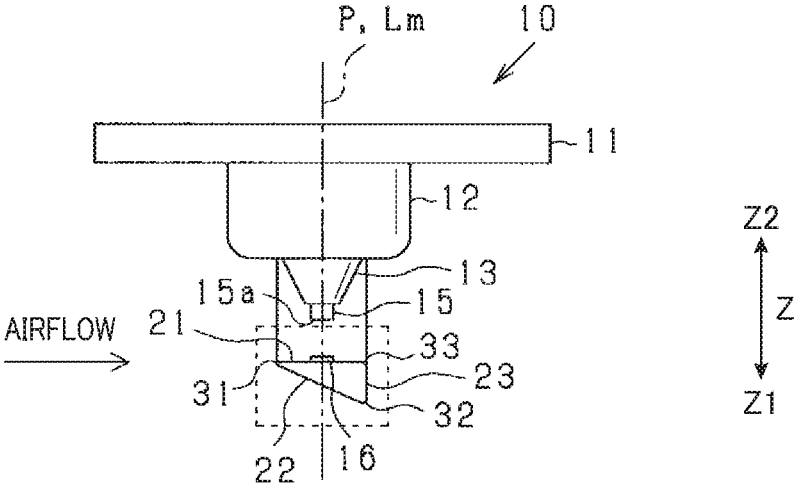
FIG. 4 is a front view of the tip end portion of the center electrode and the ground electrode.

FIG. 3 is a perspective view of the tip end portion of the center electrode 13 and the ground electrode 14. FIG. 4 is a front view of the tip end portion of the center electrode 13 and the ground electrode 14.

In the state in which the spark plug 10 is attached to the combustion chamber of the internal combustion engine, a predetermined virtual plane P (see FIG. 3) that passes through a center axis Lm of the spark plug 10 along the curved ground electrode 14 faces a flow direction of airflow in the spark plug 10. Specifically, the virtual plane P is perpendicular to the flow direction of a main airflow that flows towards the spark plug 10.

In the electrode main body 50, an opposing surface 21 that is perpendicular to the center axis Lm of the spark plug 10 is formed on a first side (upper side that corresponds to the base end side Z2) that faces the tip end surface 15*a* of the center electrode 13. The opposing surface 21 is a plan surface and spreads from an end portion (left end portion) of the ground electrode 14 on the upstream side of the airflow towards an end portion (right end portion) on the downstream side. The opposing surface 21 is substantially parallel to the tip end surface 15*a* of the center electrode 13. The opposing surface 21 is formed so as to rectify the airflow that flows between the center electrode 13 and the ground electrode 14 along the tip end surface 15*a* of the center electrode 13.

In the electrode main body 50, a sloped surface 22 is formed on a second side (lower side that corresponds to the tip end side Z1) opposite the first side facing the tip end surface 15*a* of the center electrode 13. The sloped surface 22 is formed so as to become farther away (recede) from the tip end surface 15*a*, from the upstream side of the airflow towards the downstream side. The sloped surface 22 is a plan surface and spreads from the end portion (left end portion) of the ground electrode 14 on the upstream side of the airflow towards the end portion (right end portion) on the downstream side. That is, an end portion of the sloped surface 22 on the upstream side of the airflow is equivalent to the end portion of the ground electrode 14 on the upstream side of the airflow. An end portion of the sloped surface 22 on the downstream side of the airflow is equivalent to the end portion of the ground electrode 14 on the downstream side of the airflow. The sloped surface 22 is formed so as to deflect the airflow that strikes the sloped surface 22 towards the side away from the center electrode 13.

Figure 6:
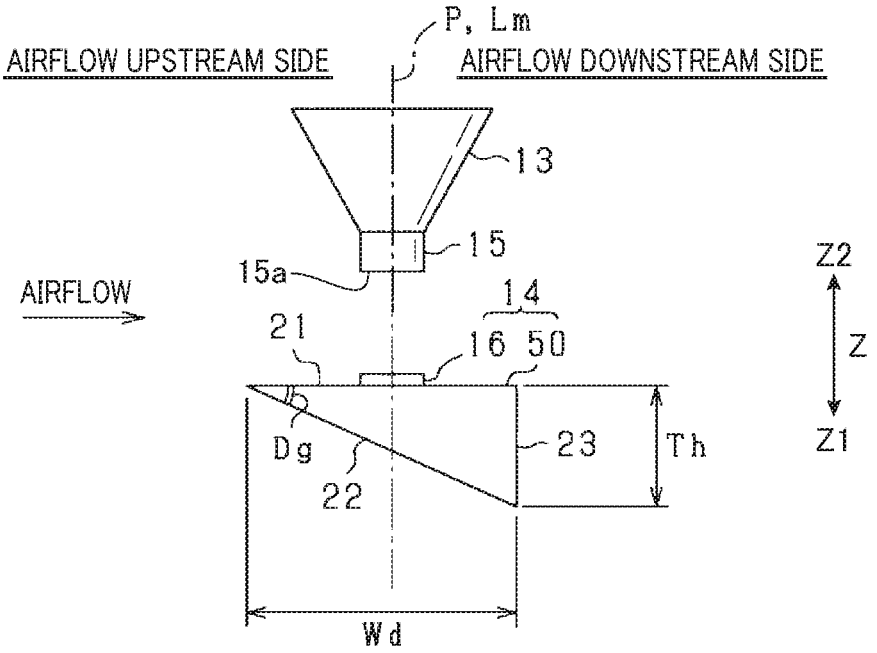
FIG. 6 is a schematic diagram of dimensions of the ground electrode in the first embodiment.

That is, in the electrode main body 50, a thickness thereof in a center axis direction (an insertion direction of the housing and the insulator 12) of the spark plug 10 is a thickness Th (see FIG. 6). The electrode main body 50 is formed such that the thickness becomes closer to Th towards the downstream side of the airflow.

According to the present embodiment, the thickness is substantially zero on the upstream side of the airflow. That is, the opposing surface 21 and the sloped surface 22 are continuous on the upstream side of the airflow. Meanwhile, in the electrode main body 50, a side surface 23 that is parallel to the virtual plane P is formed on the downstream side of the airflow. That is, the opposing surface 21 and the sloped surface 22 are indirectly connected with the side surface 23 therebetween on the downstream side of the airflow. According to the present embodiment, a cross-sectional shape of the electrode main body 50 is a triangular shape in which an angle formed by the opposing surface 21 and the side surface 23 is a right angle.

In addition, in the electrode main body 50, the noble-metal chip 16 is welded to the opposing surface 21 such that the center axes of the noble-metal chips 15 and 16 coincide with each other. As a result, the tip end surfaces 15*a* and 16*a* (see FIG. 2) of the noble-metal chips 15 and 16 are arranged so as to oppose each other over substantially their entire surfaces. The spark discharge gap 17 between the noble-metal chip 15 and the noble-metal chip 16 is formed so as to be substantially uniform. According to the present embodiment, the noble-metal chips 15 and 16 are arranged such that the center axes of the noble-metal chips 15 and 16 coincide with the center axis Lm of the spark plug 10.

Here, the electrode main body 50 of the ground electrode 14 excluding the noble-metal chip 16 is formed by a member of which a shape in a length direction is uniform being bent. Therefore, manufacturability of the ground electrode 14 can be improved.

Figure 5:
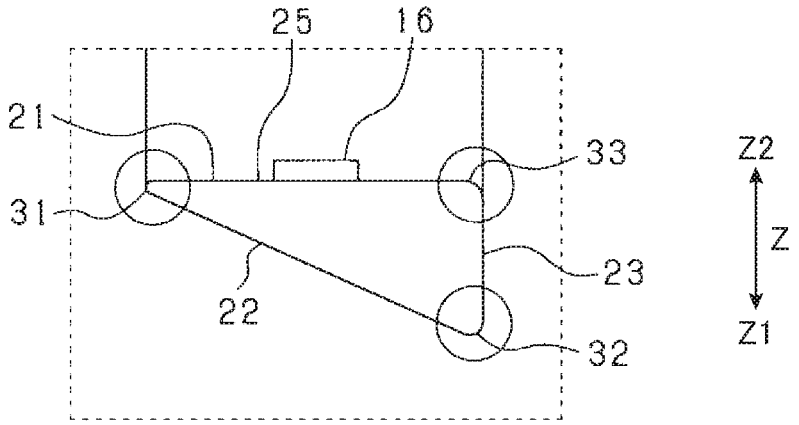
FIG. 5 is an enlarged view of a part of FIG. 4.

FIG. 5 is an enlarged view of a part of FIG. 4. As shown in the encircled sections in FIG. 5, an external surface of a connecting portion 31 between the opposing surface 21 and the sloped surface 22, an external surface of a connecting portion 32 between the sloped surface 22 and the side surface 23, and an external surface of a connecting portion 33 between the opposing surface 21 and the side surface 23 are each formed into a curved surface. That is, the connecting portions 31, 32, and 33 are each formed into a rounded portion (a semicircular columnar portion) that extends in a linear manner.

FIG. 6 is a schematic diagram of dimensions of the ground electrode 14. FIG. 6 shows a cross-section along a plane that passes through the center axis Lm of the spark plug 10 and is parallel to the flow direction of the airflow.

A width of the electrode main body 50 in a direction (the flow direction of the airflow) perpendicular to the virtual plane P is a width Wd. At this time, the thickness Th and the width Wd are set so as to satisfy 1.0 [mm]≤Th and 1.5 [mm]≤Wd.

In addition, a slope angle of the sloped surface 22 relative to the opposing surface 21 is a slope angle Dg. At this time, the slope angle Dg is set so as to satisfy 10 [°]≤Dg≤70 [°]. Preferably, the slope angle Dg is set so as to satisfy 20 [°]≤Dg≤50 [°].

Figure 7:
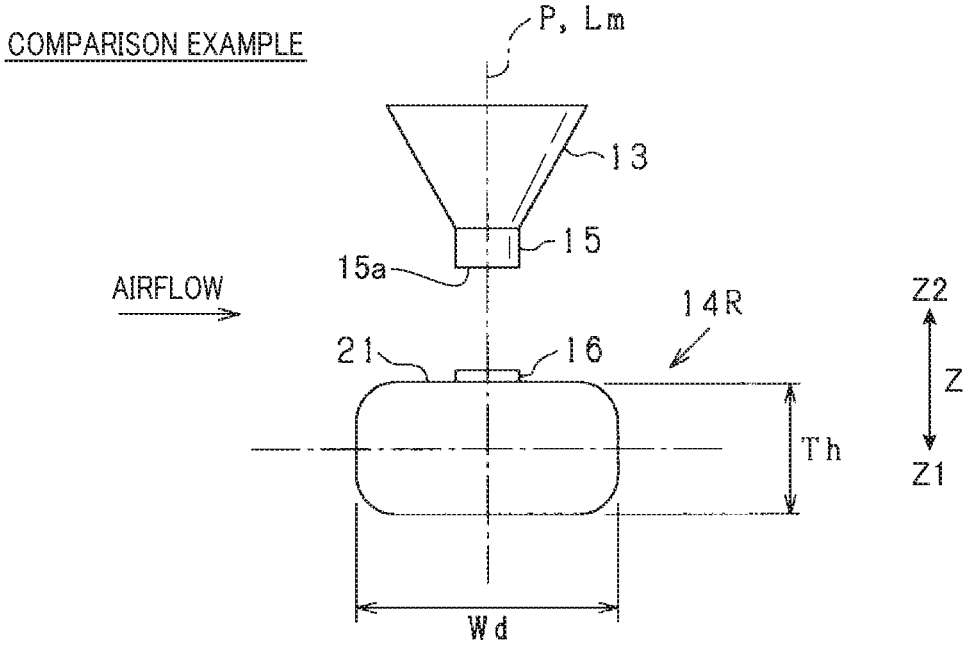
FIG. 7 is a schematic diagram of dimensions of a ground electrode provided in a spark plug in a comparison example.

FIG. 7 is a schematic diagram of dimensions of a ground electrode 14R of a comparison example. FIG. 7 shows a cross-section along a plane that passes through the center axis Lm of the spark plug 10 and is parallel to the flow direction of the airflow.

In the ground electrode 14R of the comparison example, the sloped surface 22 is not formed. The cross-sectional shape of the electrode main body 50 is rectangular. In addition, in the ground electrode 14R of the comparison example, the thickness Th and the width Wd are set such that Th=1.3 [mm] and Wd=2.6 [mm].

Figure 8:
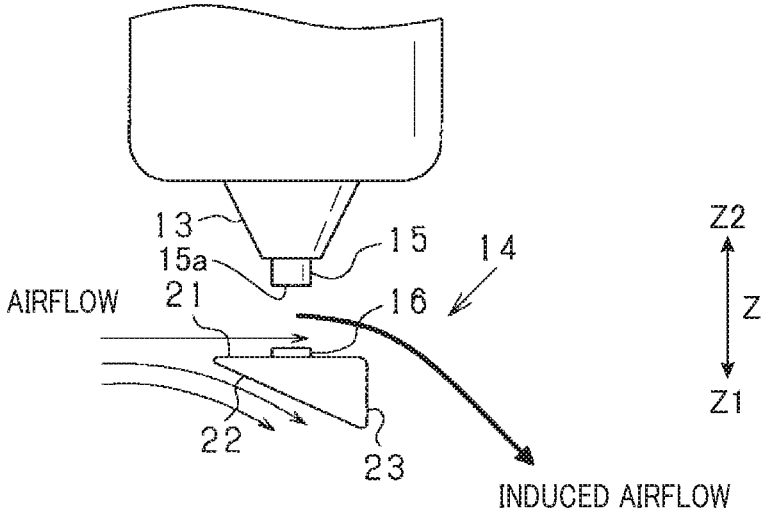
FIG. 8 is a schematic diagram of a flow direction of airflow in the first embodiment.

FIG. 8 is a schematic diagram of the flow direction of the airflow relative to the ground electrode 14.

Of the airflow that flows towards the ground electrode 14, the airflow that flows on the upper side of the ground electrode 14 is guided between the noble-metal chip 15 (center electrode 13) and the noble-metal chip 16 (ground electrode 14) along the opposing surface 21. Therefore, the airflow that flows between the noble-metal chip 15 and the noble-metal chip 16 is regulated.

The airflow that strikes the sloped surface 22 is led in a direction away from the ground electrode 14 along the sloped surface 22. Because the sloped surface 22 is formed up to the end portion of the ground electrode 14 on the upstream side, the airflow is easily led in the direction away from the ground electrode 14. The airflow then separates from the ground electrode 14 and negative pressure is formed on the downstream side of the side surface 23 (ground electrode 14). The sloped surface 22 is formed up to the end portion of the ground electrode 14 on the downstream side. Therefore, the airflow easily separates from the ground electrode 14 and the negative pressure formed on the downstream side of the side surface 23 is strengthened.

As a result, the airflow that passes between the noble-metal chip 15 and the noble-metal chip 16 is led in a direction away from the center electrode 13 by the negative pressure formed on the downstream side of the side surface 23.

Figure 9:
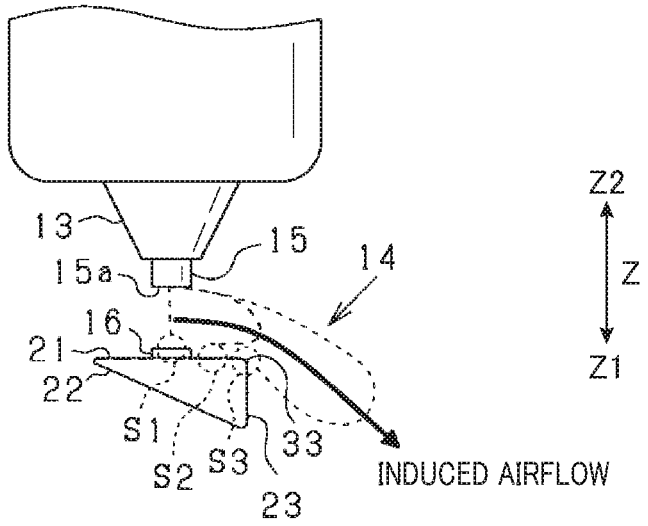
FIG. 9 is a schematic diagram of a stretching aspect of a discharge spark in the first embodiment.

FIG. 9 is a schematic diagram of a stretching aspect of a discharge spark.

A discharge spark is initially generated between the tip end surface 15*a* of the center electrode 13 and a starting point S1 on the upper surface of the noble-metal chip 16 of the ground electrode 14. Then, the discharge spark is stably extended by the regulated airflow between the noble-metal chip 15 and the noble-metal chip 16.

At this time, the starting point of the discharge spark on the ground electrode 14 moves from the starting point S1 to a starting point S2 on the opposing surface 21 that is further towards the downstream side of the airflow than the noble-metal chip 16. Therefore, a distance between the starting point of the discharge spark on the ground electrode 14 and the noble-metal chip 15 (center electrode 13) can be extended. Shorting between intermediate portions of the extended discharge spark can be suppressed.

As described with reference to FIG. 8, the airflow that passes between the noble-metal chip 15 and the noble-metal chip 16 is led in the direction away from the center electrode 13 by the negative pressure that is formed on the downstream side of the side surface 23. As a result of this airflow, the discharge spark is extended while being led in the direction away from the center electrode 13. At this time, the starting point of the discharge spark on the ground electrode 14 moves from the starting point S2 to a starting point S3 on the side surface 23. The starting point of the discharge spark on the ground electrode 14 then moves further along the side surface 23 to a position that is farther away from the center electrode 13.

Therefore, the discharge spark is stably extended in the direction away from the center electrode 13. Ignitability of an air-fuel mixture can be improved. Here, a surface area of the discharge spark increases as the discharge spark becomes longer. A contact area between the air-fuel mixture and the discharge spark increases. Therefore, ignitability of the air-fuel mixture improves. In addition, combustibility of the air-fuel mixture improves as the discharge spark stretches in the direction away from the center electrode 13, that is, in a direction towards the center of the combustion chamber.

Figure 10:
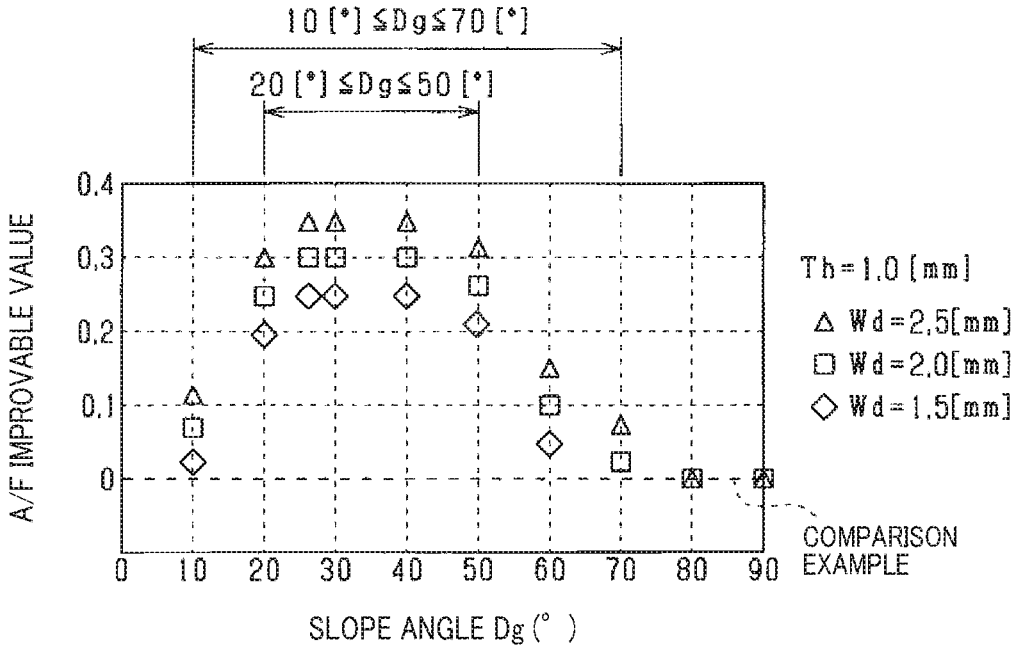
FIG. 10 is a graph of a relationship between a slope angle and an A/F improvable value in the first embodiment.

FIG. 10 is a graph of a relationship between the slope angle Dg and an A/F improvable (improvement) value. The slope angle Dg is expressed as 0 [°] when the sloped surface 22 is parallel to the opposing surface 21 and 90 [°] when the sloped surface 22 is perpendicular to the opposing surface 21. The A/F improvable value expresses a degree of improvement in a lean-limit air/fuel ratio (A/F) of the air-fuel mixture in the case of the ground electrode 14, with reference to the lean-limit A/F (0) of the air-fuel mixture in the case of the ground electrode 14R in the comparison example. Definitions of the thickness Th and the width Wd are as described with reference to FIG. 6. According to the present embodiment, the thickness Th is 1.0 [mm]. The width Wd varies among 1.5 [mm], 2.0 [mm] and 2.5 [mm]. Samples in which the slope angle Dg differs were fabricated for the ground electrode 14 of each width Wd. The lean-limit A/F was acquired for each sample and the A/F improvable value was calculated.

As shown in FIG. 10, within a range of 10 [°]≤Dg≤70 [°], the A/F improvable values of the samples of all widths Wd are equal to or greater than 0. In particular, within a range of 20 [°]≤Dg≤50 [°], the A/F improvable values of the samples of all widths Wd are equal to or greater than 0.2. Therefore, ignitability of the air-fuel mixture can be improved by the slope angle Dg being set so as to satisfy 10 [°]≤Dg≤70 [°], and in particular, 20 [°]≤Dg≤50 [°].

According to the present embodiment described in detail above, the following advantages are achieved.

In the electrode main body 50, the opposing surface 21 that is perpendicular to the center axis Lm of the spark plug 10 is formed on the first side facing the tip end surface 15*a* of the center electrode 13. Therefore, the airflow that flows between the center electrode 13 and the ground electrode 14 is regulated by the opposing surface 21. The discharge spark can be stably extended.

In the electrode main body 50, the sloped surface 22 is formed on the second side opposite the first side facing the tip end surface 15*a* of the center electrode 13. The sloped surface 22 is formed so as to become farther away (recede) from the tip end surface 15*a*, from the upstream side of the airflow towards the downstream side. Therefore, the airflow is led in the direction away from the ground electrode 14 by the sloped surface 22. Negative pressure is formed on the downstream side of the ground electrode 14. As a result of the negative pressure, the airflow that passes between the center electrode 13 and the ground electrode 14, and furthermore, the discharge spark, can be led in the direction away from the center electrode 13. Therefore, the discharge spark can be extended in the direction away from the center electrode 13. Ignitability of the air-fuel mixture can be improved.

The thickness of the electrode main body 50 in the insertion direction of the center electrode 13 is the thickness Th. The width of the electrode main body 50 in the direction perpendicular to the virtual plane P is the width Wd. In the electrode main body 50, 1.0 [mm]≤Th and 1.5 [mm]≤Wd. Therefore, negative pressure that is sufficient to enable the discharge spark to be extended in the direction away from the center electrode 13 can be formed by the sloped surface 22.

As shown in FIG. 10, in the electrode main body 50, when the slope angle of the sloped surface 22 relative to the opposing surface 21 is the slope angle Dg, and 10 [°]≤Dg≤70 [°], ignitability of the air-fuel mixture is improved. Therefore, as a result of the above-described spark plug 10, ignitability of the air-fuel mixture can be improved.

In the electrode main body 50, the noble-metal chip 16 is fixed to the opposing surface 21 such that the center axes of the noble-metal chip 15 and the noble-metal chip 16 coincide. As a result of the noble-metal chip 15 and the noble-metal chip 16 being fixed such that the center axes thereof coincide, an area of the opposing portions of the tip end surfaces 15*a* and 16*a* of the noble-metal chips 15 and 16 (see FIG. 2) that are arranged so as to oppose each other can be ensured, compared to when the noble-metal chip 15 and the noble-metal chip 16 are arranged such that the center axes are shifted.

The opposing portions are portions at which a distance between the noble-metal chip 15 and the noble-metal chip 16 is shortest. Therefore, in the discharge between the noble-metal chip 15 and the noble-metal chip 16, the discharge spark is generated in the opposing portions. As a result of wear in the opposing portions caused by the discharge spark, the spark discharge gap 17 between the opposing portions widens.

When the area of the opposing portions is large, a speed at which the spark discharge gap 17 widens between the opposing portions as a result of wear in the opposing portions can be delayed. Therefore, a number of discharges until the spark discharge gap 17 between the noble-metal chip 15 and the noble-metal chip 16 becomes a predetermined width can be increased. Durability of the spark plug 10 can be improved.

As shown in FIG. 10, in the electrode main body 50, when the slope angle of the sloped surface 22 relative to the opposing surface 21 is the slope angle Dg, and 20 [°]≤Dg≤50 [°], ignitability of the air-fuel mixture is further improved. Therefore, as a result of the above-described spark plug 10, ignitability of the air-fuel mixture can be further improved.

In the electrode main body 50, the end portion of the sloped surface 22 on the upstream side of the airflow is equivalent to the end portion of the ground electrode 14 on the upstream side of the airflow. Therefore, the airflow that strikes the ground electrode 14 strikes the sloped surface 22 and can be easily led to the direction away from the center electrode 13. Consequently, negative pressure can be easily formed on the downstream side of the ground electrode 14. Ignitability of the air-fuel mixture can be further improved.

In the electrode main body, the end portion of the sloped surface 22 on the downstream side of the airflow is equivalent to the end portion of the ground electrode 14 on the downstream side of the airflow. Therefore, the airflow along a plane on the second side opposite the first side facing the tip end surface 15*a* of the center electrode 13 can be easily led in the direction away from the center electrode 13 by the sloped surface 22 in the end portion of the ground electrode 14 on the downstream side of the airflow. Consequently, negative pressure can be easily formed on the downstream side of the ground electrode 14. Ignitability of the air-fuel mixture can be further improved.

In the electrode main body 50, the external surface of the connecting portion 33 between the opposing surface 21 and the side surface 23 is formed into a curved surface. Therefore, when the starting point of the discharge spark on the ground electrode 14 moves along the opposing surface 21, from the upstream side of the airflow to the downstream side, the starting point of the discharge spark on the ground electrode 14 can easily move along the external surface of the connecting portion 33 to a position that is farther away from the center electrode 13. Consequently, the discharge spark can be easily moved to a position that is farther away from the center electrode 13. Ignitability of the air-fuel mixture can be further improved.

Second Embodiment

A second embodiment will be described below with reference to the drawings, mainly focusing on differences with the above-described first embodiment.

Figure 11:
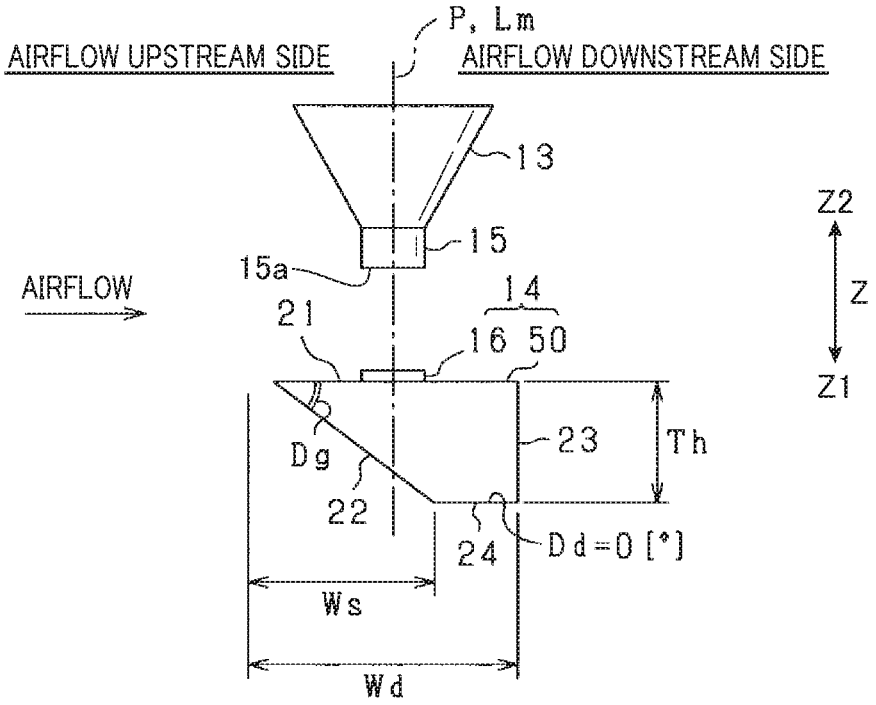
FIG. 11 is a schematic diagram of the dimensions of the ground electrode provided in the spark plug according to a second embodiment.

According to the present embodiment, the shape of the ground electrode 14 differs. As shown in FIG. 11, the ground electrode 14 according to the present embodiment includes that in which the end portion of the sloped surface 22 on the downstream side of the airflow is not equivalent to the end portion of the ground electrode 14 on the downstream side of the airflow. In FIG. 11, sections that are identical to those shown in FIG. 4, described above, are given the same reference number for convenience. Descriptions thereof are omitted.

FIG. 11 is a schematic diagram of the dimensions of the ground electrode 14. FIG. 11 shows a cross-section along a plane that passes through the center axis Lm of the spark plug 10 and is parallel to the flow direction of the airflow.

In the example shown in FIG. 11, in the electrode main body 50, the sloped surface 22 and a downstream-side surface 24 are formed on the second side (lower side) opposite the first side (upper side) facing the tip end surface 15*a* of the center electrode 13. The downstream-side surface 24 is a plan surface and spreads from the end portion of the sloped surface 22 on the downstream side of the airflow to the end portion of the ground electrode 14 on the downstream side of the airflow.

A slope angle of the downstream-side surface 24 relative to the opposing surface 21 is a slope angle Dd. At this time, the slope angle Dd is set so as to satisfy Dd<10 [°]. According to the present embodiment, the downstream-side surface 24 is set so as to be parallel to the opposing surface 21. That is, the downstream-side surface 24 is formed such that the airflow that is deflected towards a side away from the center electrode 13 by the sloped surface 22 approaches the side surface 23. As a result, the negative pressure that is formed on the downstream side of the side surface 23 is strengthened.

According to the present embodiment, in the electrode main body 50, a width of the sloped surface 22 in the direction perpendicular to the virtual plane P is a width Ws. At this time, the width Ws and a slope ratio Ws/Wd are set so as to satisfy 0.6≤Ws/Wd≤1.0.

Figure 12:
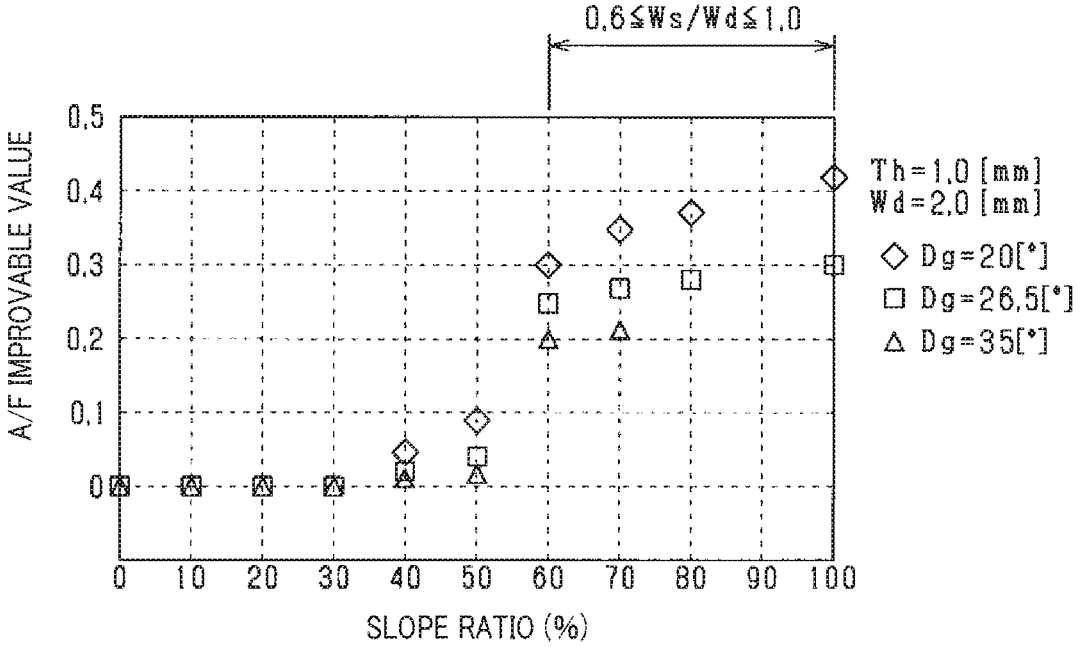
FIG. 12 is a graph of a relationship between a slope ratio and the A/F improvable value in the second embodiment.

FIG. 12 is a graph of a relationship between the slope ratio Ws/Wd and the A/F improvable value. The slope ratio Ws/Wd is expressed as 0.0 when the sloped surface 22 is not formed and 1.0 when the downstream-side surface 24 is not present. According to the present embodiment, the thickness Th is 1.0 [mm], the width Wd is 2.0 [mm], and the slope angle Dg varies among 20 [°], 26.5 [°], and 35 [°]. In addition, a sample in which the slope ratio is changed is fabricated for the ground electrode 14 of each slope angle. Samples in which the slope ratio Ws/Wd differs were fabricated for the ground electrode 14 of each slope angle Dg. The lean-limit A/F was acquired for each sample and the A/F improvable value was calculated.

As shown in FIG. 12, within a range of 20 [°]≤Dg≤35 [°], the A/F improvable value further increases when 0.6≤Ws/Wd≤1.0. Therefore, as a result of the width Ws being set so as to satisfy 20 [°]≤Dg≤35 [°] and 0.6≤Ws/Wd≤1.0, ignitability of the air-fuel mixture can be further improved.

According to the present embodiment described above, the inventors of the present application have confirmed that ignitability of the air-fuel mixture is further improved when, in the electrode main body 50, the width of the sloped surface 22 in the direction perpendicular to the virtual plane P is the width Ws and 0.6≤Ws/Wd≤1.0. Therefore, as a result of the above-described spark plug 10, ignitability of the air-fuel mixture can be further improved.

Here, the above-described embodiments can be modified in the following manner. Sections that are identical to those according to the above-described embodiments are given the same reference numbers. Therefore, descriptions thereof are omitted.

A configuration in which the external surfaces of the connecting portions 31 to 33 are not formed into curved surfaces can also be used. In this case, processing of the ground electrode 14 is facilitated.

Figure 13A:
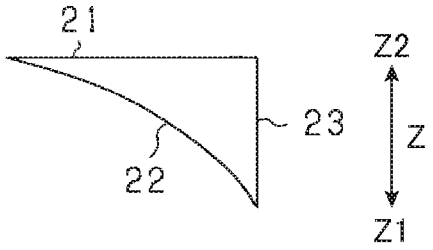
FIG. 13A to FIG. 13F are schematic diagrams of variation examples of a shape of the ground electrode.
Figure 13D:
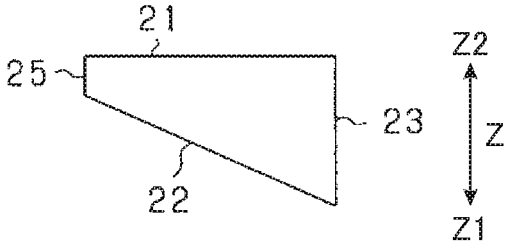
Figure 13B:
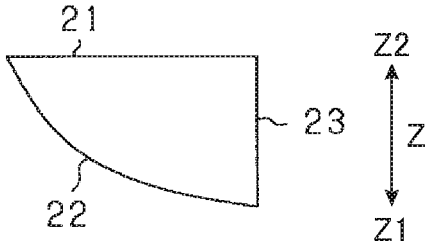
Figure 13E:
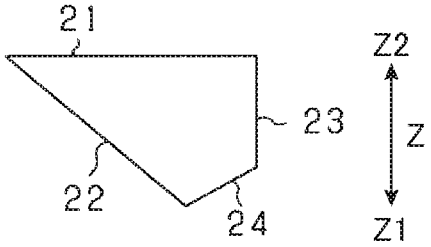
Figure 13C:
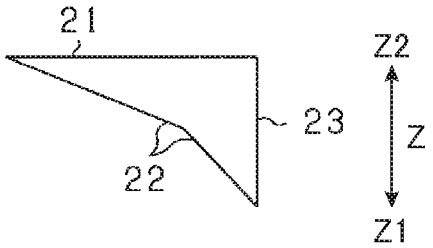

FIG. 13A to FIG. 13F are schematic diagrams of variation examples of the shape of the ground electrode 14. As shown in FIG. 13A, the sloped surface 22 may be shaped so as to recess towards the center side of the electrode main body 50. As shown in FIG. 13B, the sloped surface 22 may be shaped so as to protrude toward the outer side of the electrode main body 50. In addition, as shown in FIG. 13A and FIG. 13B, the sloped surface 22 may be formed by a curved surface. Alternatively, as shown in FIG. 13C, the sloped surface 22 may be formed by a plurality of planes (flat surfaces).

As shown in FIG. 13A and FIG. 13B, when the sloped surface 22 is formed by a curved surface, all that is required is that the slope angle Dg at any portion of the sloped surface 22 be 10 [°]≤Dg≤70 [°] (20 [°]≤Dg≤50 [°]). In addition, as shown in FIG. 13C, when the sloped surface 22 is formed by a plurality of planes, all that is required is that the slope angle Dg of each plane configuring the sloped surface 22 be 10 [°]≤Dg≤70 [°] (20 [°]≤Dg≤50 [°]).

As shown in FIG. 13D, in the electrode main body 50, a side surface 25 that is parallel to the virtual plane P may be formed on the upstream side of the airflow.

As shown in FIG. 13E, the downstream-side surface 24 may be sloped so as to approach the tip end surface 15*a*, from the upstream side of the airflow towards the downstream side. As a result, compared to cases in which the downstream surface 24 is set so as to be parallel to the opposing surface 21, the electrode main body 50 can be formed to be smaller in size.

Figure 13F:
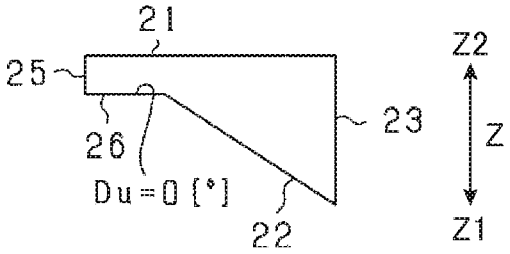

As shown in FIG. 13F, the end portion of the sloped surface 22 on the upstream side of the airflow may not be equivalent to the end portion of the ground electrode 14 on the upstream side of the airflow.

In the variation example shown in FIG. 13F, in the electrode main body 50, an upstream-side surface 26 and the sloped surface 22 are formed on the second side (lower side) opposite the first side (upper side) facing the tip end surface 15*a* of the center electrode 13. The upstream-side surface 26 is a plan surface and spreads from the end portion of the ground electrode 14 on the upstream side of the airflow to the end portion of the sloped surface 22 on the upstream side of the airflow.

A slope angle of the upstream-side surface 26 relative to the opposing surface 21 is a slope angle Du. At this time, the slope angle Du is set so as to satisfy Du<10 [°]. According to the present embodiment, the upstream-side surface 26 is set so as to be parallel to the opposing surface 21. That is, the upstream-side surface 26 is formed so as to lead the airflow that flows on the lower side of the ground electrode 14 to the sloped surface 22 along the ground electrode 14.

In the variation example shown in FIG. 13F, in the electrode main body 50, the width of the sloped surface 22 in the direction perpendicular to the virtual plane P is the width Ws. At this time, the width Ws and the slope ratio Ws/Wd are set so as to satisfy 0.6≤Ws/Wd≤1.0.

As a result of the variation example shown in FIG. 13F, the airflow that flows on the lower side of the ground electrode 14 is led to the sloped surface 22 along the upstream-side surface 26. The airflow that strikes the sloped surface 22 is led in the direction away from the ground electrode 14 along the sloped surface 22. In particular, in the variation example shown in FIG. 13F, the sloped surface 22 is formed in the end portion of the ground electrode 14 on the downstream side of the airflow. Therefore, when the airflow that strikes the sloped surface 22 moves away from the ground electrode 14, the airflow can be easily led in the direction away from the center electrode 13. Therefore, negative pressure can be easily formed on the downstream side of the ground electrode 14. Ignitability of the air-fuel mixture can be further improved.

The width Ws is not necessarily required to be set so as to satisfy 0.6≤Ws/Wd≤1.0. The width Ws may be set so as to satisfy 0<Ws/Wd<0.6.

The side surface 23 may be shaped so as to recess towards the center side of the electrode main body 50 or protrude towards the outer side of the electrode main body 50.

What is claimed is:

1. A spark plug comprising:

a cylindrical main metal fitting that includes an interior portion;

a center electrode that is inserted into the interior portion of the main metal fitting and includes a tip end surface; and a ground electrode that is connected to the main metal fitting and curved so as to oppose the tip end surface of the center electrode, wherein a predetermined virtual plane (P) that passes through a center axis of the spark plug along the curved ground electrode faces a flow direction of airflow in the spark plug, the center electrode and the ground electrode oppose each other and form a spark discharge gap, the ground electrode includes a main body that includes an opposing surface that is formed on a first side facing the tip end surface of the center electrode, the opposing surface being perpendicular to the center axis of the spark plug, and a sloped surface that is formed on a second side opposite the first side facing the tip end surface of the center electrode, the sloped surface becoming farther away from the tip end surface of the center electrode from an upstream side of the airflow towards a downstream side, and the main body of the ground electrode satisfies 10 [°]≤Dg≤70 [°], 1.0 [mm]≤Th, and 1.5 [mm]≤Wd, where Dg is a slope angle of the sloped surface relative to the opposing surface, Th is a thickness of the main body of the ground electrode in an insertion direction of the center electrode, and Wd is a width of the ground electrode in a direction perpendicular to the virtual plane.

2. The spark plug according to claim 1, wherein:

the center electrode includes a columnar first protruding portion that includes a noble metal in a tip end portion of the center electrode, and a tip end surface of the first protruding portion is the tip end surface of the center electrode;

the ground electrode includes the main body of the ground electrode and a columnar second protruding portion that includes a noble metal; and the second protruding portion is provided on the opposing surface such that respective center axes of the first protruding portion and the second protruding portion coincide.

3. The spark plug according to claim 1, wherein:

the main body of the ground electrode satisfies 20 [°]≤Dg≤50 [°].

4. The spark plug according to claim 2, wherein:

the main body of the ground electrode satisfies 20 [°]≤Dg≤50 [°].

5. The spark plug according to claim 1, wherein:

the main body of the ground electrode satisfies Ws, 0.6≤Ws/Wd≤1.0, where Ws is a width of the sloped surface.

6. The spark plug according to claim 4, wherein:

the main body of the ground electrode satisfies Ws, 0.6≤Ws/Wd≤1.0, where Ws is a width of the sloped surface.

7. The spark plug according to claim 1, wherein:

in the main body of the ground electrode, an end portion of the sloped surface on the upstream side of the airflow is equivalent to an end portion of the ground electrode on the upstream side of the airflow.

8. The spark plug according to claim 6, wherein:

in the main body of the ground electrode, an end portion of the sloped surface on the upstream side of the airflow is equivalent to an end portion of the ground electrode on the upstream side of the airflow.

9. The spark plug according to claim 1, wherein:

in the main body of the ground electrode, an end portion of the sloped surface on the downstream side of the airflow is equivalent to an end portion of the ground electrode on the downstream side of the airflow.

10. The spark plug according to claim 8, wherein:

in the main body of the ground electrode, an end portion of the sloped surface on the downstream side of the airflow is equivalent to an end portion of the ground electrode on the downstream side of the airflow.

* * * * *